United States Patent [19]

Hannett et al.

[11] 4,335,580

[45] Jun. 22, 1982

[54] REFRIGERATION UNIT WITH WATER COOLED CONDENSER

[75] Inventors: William J. Hannett, Jamesville; Thomas E. Brendel; David S. Wilson, both of Fayetteville, all of N.Y.

[73] Assignee: Carrier Corporation, Syracuse, N.Y.

[21] Appl. No.: 245,880

[22] Filed: Mar. 23, 1981

Related U.S. Application Data

[62] Division of Ser. No. 92,297, Nov. 8, 1979, Pat. No. 4,295,344.

[51] Int. Cl.[3] ..... F25B 7/00; F25B 27/02; F25B 13/00

[52] U.S. Cl. ..... 62/79; 62/82; 62/183; 62/238.6; 62/324.1; 62/324.3; 62/506

[58] Field of Search ..... 62/79, 82, 183, 324.1, 62/324.3, 258.6, 506

[56] References Cited

U.S. PATENT DOCUMENTS

| | | | |
|---|---|---|---|
| 2,142,734 | 1/1939 | Polley | 62/506 X |
| 3,188,829 | 6/1965 | Slewert et al. | 62/324.1 |
| 3,322,188 | 5/1967 | Ostrander | 62/79 |
| 3,636,721 | 1/1972 | Rex | 62/324.3 |
| 3,822,566 | 7/1974 | Lowi, Jr. | 62/324.3 |
| 3,959,986 | 6/1976 | Ledermann | 62/324.3 |
| 3,986,664 | 10/1976 | Gustafsson | 62/238.6 |
| 3,989,183 | 11/1976 | Gustafsson | 62/238.6 |
| 4,165,037 | 8/1979 | McCarson | 62/238.6 |

*Primary Examiner*—Lloyd L. King
*Attorney, Agent, or Firm*—J. Raymond Curtin

[57] ABSTRACT

An engine-driven refrigeration unit includes a first heat exchanger functioning alternatively as a refrigerant condenser or as a refrigerant evaporator. When the heat exchanger is functioning as a refrigerant evaporator the heat transfer medium furnished thereto for providing a source of heat to vaporize the refrigerant is preheated by absorbing heat from a relatively warm fluid employed as the cooling medium for the engine driving the refrigeration unit.

6 Claims, 3 Drawing Figures

REFRIGERATION UNIT WITH WATER COOLED CONDENSER

This application is a division of application Ser. No. 92,297, filed Nov. 8, 1979, now U.S. Pat. No. 4,295,344.

BACKGROUND OF THE INVENTION

This invention relates to an engine-driven refrigeration unit, and in particular to a refrigeration unit having a first heat exchanger functioning as either a condenser or an evaporator. The first heat exchanger receives water for either condensing or evaporating refrigerant supplied thereto.

Engine-driven refrigeration units, such as those employed on board boats or ships, generally require some means to defrost the evaporator of the unit. Sometimes the unit is operated in a reverse or heat pump mode to defrost the evaporator. In the defrost mode, a heat exchanger, normally functioning as the refrigeration unit evaporator, functions as a refrigerant condenser, with the first heat exchanger, normally functioning as the condenser, thence operating as an evaporator. During the defrost mode, heat is absorbed from the nominal "condensing medium" and transferred to the refrigerant, with the vaporized refrigerant thereafter rejecting heat to defrost the coils of the "condenser". On ship board units, water from any source, such as an ocean, lake or river, (hreinafter collectively referred to as "sea water") is preferably employed as the condensing or evaporating medium for the first heat exchanger. The temperature of the sea water may vary through a relatively broad range depending upon ambient temperature. As an example, in relatively warm climates, sea water temperature may exceed 31° C., whereas in relatively cold climates the temperature of the water may fall to 4° C. or even lower. When the sea water is employed as a source of heat during the defrost mode of operation of the refrigeration unit, the temperature of the water is substantially reduced as it flows through the heat exchanger functioning as the evaporator. If the initial temperature of the water is 15° C. or lower, the water may not contain sufficient heat to permit efficient and effective defrosting of the coils. In effect, during the defrost operation, heat is transferred from the water to the refrigerant. Heat is rejected by the refrigerant in the second heat exchanger. With a relatively small amount of heat available in the sea water, the defrosting operation will take a relatively long period of time. An increase in the temperature of the refrigerated cargo may occur if the defrosting operation is unduly prolonged. With highly perishable goods or goods requiring rigid temperature control, any temperature increase resulting from an excessively long defrost operation is undesirable, and in some applications intolerable.

SUMMARY OF THE INVENTION

Accordingly, it is an object of this invention to improve refrigeration units using sea water as a source of heat for vaporizing refrigerant.

It is another object of this invention to transfer heat from the cooling system of an engine to the sea water furnished to the heat exchanger functioning as a refrigerant evaporator when the refrigeration unit is functioning in a reverse cycle.

It is yet another object of this invention to increase the heat available in sea water employed as a source of heat in a reverse cycle refrigeration unit.

These and other objects of the present invention are attained in an engine-driven refrigeration unit having a first heat exchanger functioning as a condenser in a first operating mode and as an evaporator in a second operating mode of the refrigeration unit. The unit includes means for delivering relatively cold sea water from a source thereof to the first heat exchanger for condensing refrigerant vapor delivered thereto when the heat exchanger is functioning as a condenser, and for vaporizing the refrigerant when the heat exchanger is functioning as an evaporator; a second heat exchanger connected to a source of relatively warm fluid; a conduit connecting the first and second heat exchangers for delivering the sea water to the second heat exchanger to pass in heat transfer relation with the relatively warm fluid, thereby increasing the temperature of the sea water and reducing the temperature of the relatively warm fluid; discharge means connected to the second heat exchanger including valve means having a first position for directing the sea water from the second heat exchanger to the source and a second position for directing the sea water to the inlet of the first heat exchanger; and means for placing the valve means in the second position when the first heat exchanger is functioning as a refrigerant evaporator.

DESCRIPTION OF THE PREFERRED EMBODIMENTS

Referring now to the figures of the drawings, there is schematically illustrated preferred embodiments of the present invention. In referring to the figures of the drawings, like numerals shall refer to like parts.

Figure 1:
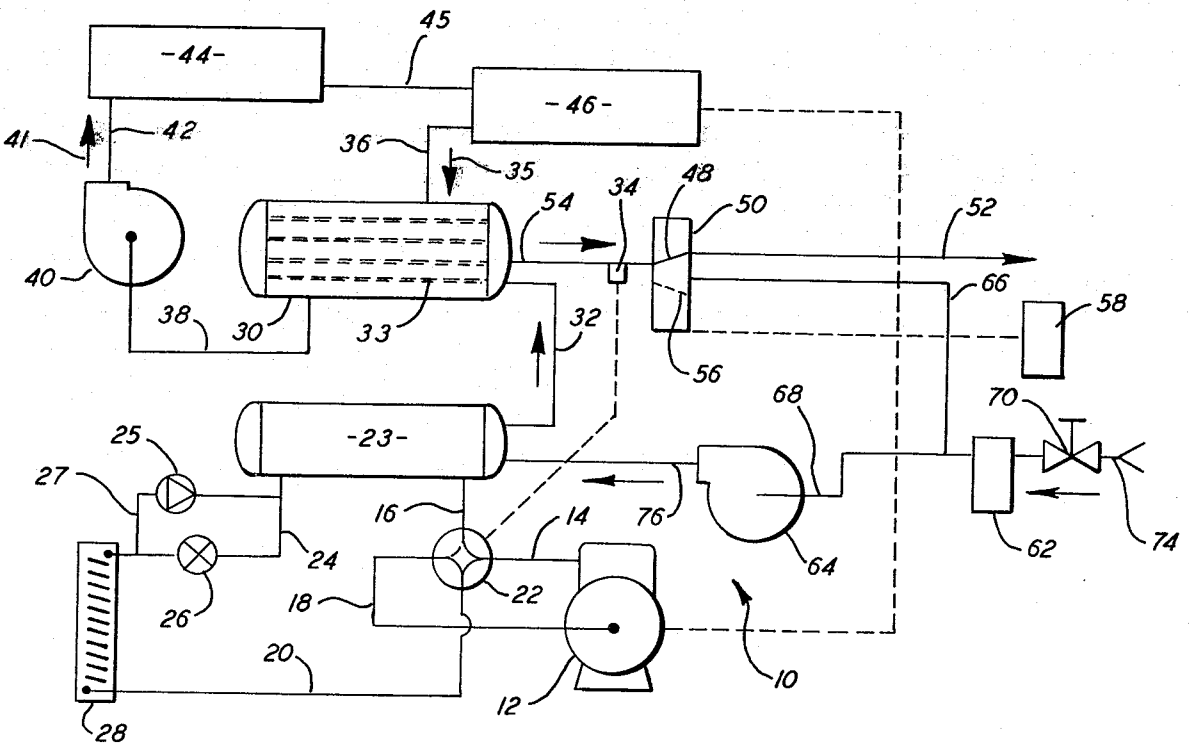
FIG. 1 of the drawing is a schematic representation of a refrigeration unit operating in a refrigeration mode and embodying the present invention.
Figure 2:
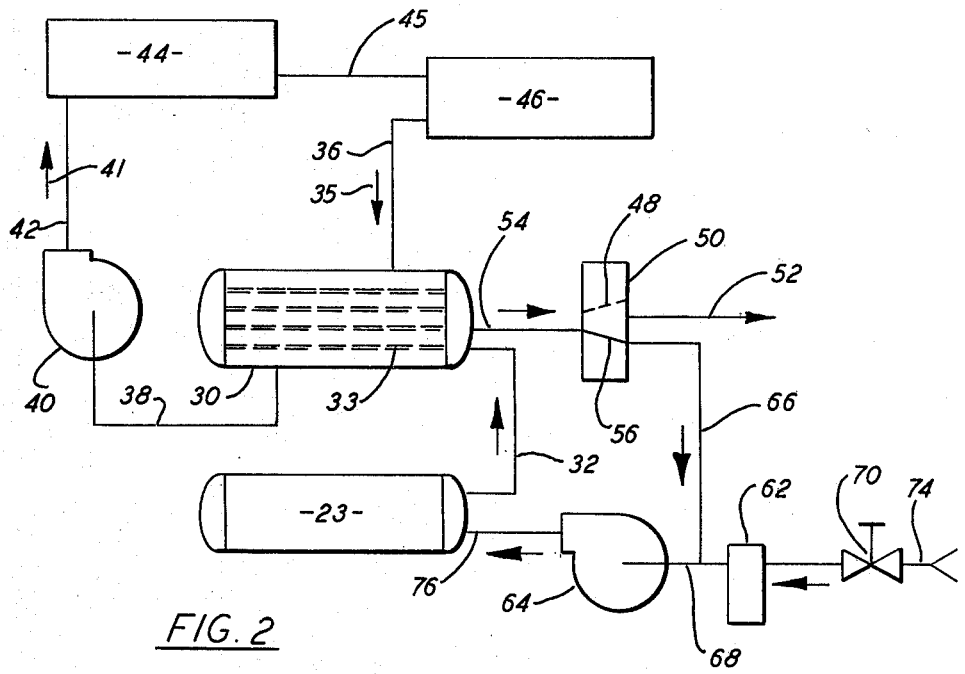
FIG. 2 is a view similar to FIG. 1 showing the refrigeration unit operating in a reverse cycle mode.

Referring particularly to FIGS. 1 and 2, there is illustrated an engine-driven refrigeration unit 10 such as may be found on board a ship or boat. The refrigeration unit includes a compressor 12 having a first conduit 14 connected to the discharge portion of the compressor and a second conduit 18 connected to the suction side of the compressor. Unit 10 further includes a four-way valve 22 interposed in conduits 14, 16, 18 and 20. The unit further includes a first heat exchanger 23 functioning as a condenser during normal operation of the refrigeration unit. In the preferred embodiment, heat exchanger 23 includes a plurality of tubes defining parallel flow paths for a heat transfer medium supplied to the heat exchanger. During normal operation of the unit, vaporous refrigerant is discharged from compressor 12, through conduit 14, through valve 22, and thence into conduit 16 for delivery into heat exchanger 23. The vaporous refrigerant is condensed in heat exchanger 23 by passing in heat transfer relation with a heat transfer medium delivered to the heat exchanger through conduit 76. The condensed refrigerant exits from the heat exchanger through conduit 24 and passes into an expansion device such as thermal expansion valve 26 and thence into a second heat exchanger 28 functioning as a refrigerant evaporator during normal operation of the refrigeration unit. The vaporous refrigerant formed in evaporator 28 exits therefrom and flows through conduit 20, valve 22, and thence into conduit 18 for return to compressor 12.

The heat transfer medium furnished to first heat exchanger 23 is supplied from a suitable source such as an ocean, lake or stream (hereinafter referred to collectively as "sea water").

The sea water is delivered through conduit 74, valve 70 and filter 62 to conduit 68 serving as a suction line for pump 64. The pump supplies the sea water through conduit 76 to first heat exchanger 23.

As indicated previously, during normal operation of the refrigeration unit heat exchanger 23 functions as a refrigerant condenser; accordingly, the temperature of the sea water delivered thereto is increased as it absorbs heat from the vaporous refrigerant and condenses same.

The sea water passes from first heat exchanger 23 via conduit 32 to a third heat exchanger 30. Heat exchanger 30 is of the shell and tube type. Conduit 32 delivers the sea water to heat exchanger 30, with the sea water flowing through tubes 33 of the heat exchanger in heat transfer relation with a relatively warm fluid delivered to heat exchanger 30 via conduit 36. The fluid delivered to heat exchanger 30 is preferably the fluid employed to cool the engine driving the refrigeration unit. The engine coolant may be water, or a mixture of water and ethylene glycol or any other suitable fluid which can be used for cooling the engine. The heat transfer fluid employed in the cooling system rejects heat to the heat transfer medium flowing through tube bundle 33. The engine coolant is discharged from heat exchanger 30 via conduit 38 and thence pumped via pump 40 through conduit 42 to an expansion tank 44, conduit 45, and thence into a portion 46 of the engine requiring cooling . The engine is suitably connected to compressor 12 to drive the same. Arrows 41 and 35 indicate the direction of flow of the fluid employed in the engine cooling system.

The sea water flowing through tube 33 extracts heat from the coolant flowing about the tubes and exits from heat exchanger 30 via conduit 54. Conduit 54 delivers the sea water to a three-way valve 50. In FIG. 1, solid line 48 indicates the operating mode of valve 50 when in a first operating position whereby conduit 54 is communicated with conduit 52. In FIG. 2, solid line 56 indicates the operating position of the valve when in a second operating mode whereby conduit 54 is in communication with conduit 66 through valve 50.

When conduits 54 and 52 are in communication through valve 50, the sea water is returned to the source thereof. When conduits 54 and 66 are in communication through valve 50, the sea water is supplied to the suction side of pump 64. A controller 58 operates three-way valve 50. Four-way valve 22 is preferably controlled in response to temperature sensor 34 operable to sense the temperature of the sea water flowing through conduit 54.

A description of the operation of the refrigeration unit during normal mode of operation is not deemed necessary as the unit is thence functioning as a normal refrigeration unit. As mentioned previously, FIG. 1 depicts the unit operating in its refrigeration mode. However, when frost builds up on the surface of the coils of heat exchanger 28 defrosting thereof is required. It is desirable to place the refrigeration unit in a reverse cycle mode of operation whereby first heat exchanger 23 functions as a refrigerant evaporator and second heat exchanger 28 functions as a refrigerant condenser. The heat rejected in condensing the refrigerant is employed to defrost the coils of heat exchanger 28. In this mode of operation, valve 22 will be placed in position such that compressor discharge conduit 14 communicates with conduit 20 and compressor suction conduit 18 communicates with conduit 16 of first heat exchanger 23. Thus, refrigerant discharged from compressor 14 is delivered through conduit 20 to second heat exchanger 28; the condensed refrigerant thereafter passing through bypass conduit 27 having check valve 25 disposed therein permitting flow through the conduit from heat exchanger 28 to heat exchanger 23. Refrigerant evaporated in first heat exchanger 23 is delivered through conduit 16 to conduit 18 and thence into the suction side of compressor 12. When it is desired to defrost heat exchanger 28, three-way valve 50 is placed in the position illustrated in FIG. 2 through operation of controller 58. When temperature sensor 34 senses the temperature of the sea water flowing through conduit 54 has reached a predetermined level, the sensor operates to place valve 22 in its reverse cycle or defrost mode of operation.

The temperature of the sea water furnished to first heat exchanger 23 via pump 64 is variable; the temperature of the sea water will vary in accordance with changes in ambient temperature. When employed as a source of heat to evaporate the refrigerant furnished to first heat exchanger 23 the temperature of the sea water is substantially reduced. If the temperature of the sea water is initially relatively low, the extraction of heat therefrom substantially reduces the temperature thereof. With relatively low temperature sea water, there will only be a limited amount of heat available for transfer to the refrigerant for ultimate use in defrosting heat exchanger 28. As indicated previously, the foregoing can result in a prolonged defrost cycle, which is generally unacceptable.

To prevent the foregoing, the sea water discharged from tubes 33 is maintained within the system by communicating conduit 54 with conduit 66. The heat rejected from the engine via the passage of the engine coolant through heat exchanger 30 in heat exchange relation with the sea water flowing through bundle 33 increases the temperature of the sea water. The increased temperature sea water is delivered to the suction side of pump 64 as shown in FIG. 2. In effect, the movement of valve 50 to its defrost mode position, establishes a closed-loop flow for the sea water. Flow of sea water from the source through valve 70 is substantially terminated when valve 50 is placed in the position illustrated in FIG. 2.

Figure 3:
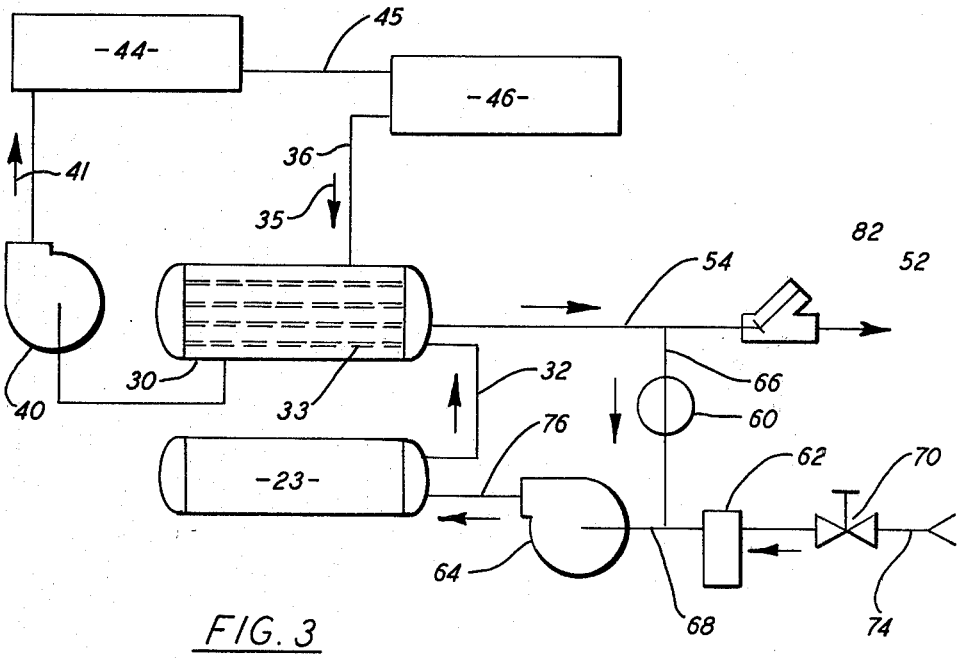
FIG. 3 is a schematic illustration of a refrigeration unit illustrating an alternative embodiment of the invention.

Referring now to FIG. 3, it will be observed that essentially this embodiment is identical to that illustrated in FIGS. 1 and 2. The only change is the elimination of three-way valve 50 and in lieu thereof, a two-way valve 60 and a check valve 82 are provided to define the alternative flow paths for the sea water discharged through conduit 54. FIG. 3 illustrates valve 60 in its operating position whereby the relatively warm sea water is returned to the suction side of pump 64 after it has been heated in heat exchanger 30.

As noted previously, it is preferable that valve 50 be placed in its defrost mode position prior to valve 22 being placed in its reverse cycle position. The sequential operation of valves 50 and 22 permits the temperature of the sea water flowing within the closed-loop illustrated in FIG. 2 to substantially increase before defrosting actually commences. It has been found that generally the engine does not provide sufficient heat to the engine coolant to increase the temperature of the sea water as rapidly as the sea water is rejecting heat to vaporize the refrigerant in heat exchanger 23. The foregoing results in reducing the effectiveness of the invention.

To overcome this problem, controller 58 places valve 50 in its defrost mode position while valve 22 is initially maintained in its refrigeration mode position (see FIG. 1). This results in an increase in the temperature of the sea water, as the sea water is still used for condensing refrigerant in heat exchanger 23. When the temperature of the sea water has been increased to a predetermined level, e.g. 31° C., sensor 34 places valve 22 in its defrost mode position. In the event defrosting of coil 28 should continue for a relatively long period of time resulting in a reduction of the temperature of the sea water, sensor 34 will return valve 22 to its refrigeration position if the temperature of the water should decrease below a predetermined level, enabling the temperature of the sea water to again increase. In the event engine 46 provides ample heat to compensate for the rejection of heat to the refrigerant during the defrost mode, valve 22 may be moved into its defrost mode concurrently with the movement of valve 50 into its defrost position.

The foregoing invention raises the temperature of sea water employed as a source of heat for defrosting the evaporator of a refrigeration unit operable in a reverse cycle during defrosting. The invention increases the efficiency of the defrosting cycle.

It should be understood, while the invention has been specifically described with respect to a refrigeration unit used on board a ship or boat, the invention may be used in other applications having a water cooled "condenser".

While preferred embodiments of the present invention have been described and illustrated, the invention should not be limited thereto but may be otherwise embodied within the scope of the following claims.

We claim:

1. A method of operating an engine-driven refrigeration unit comprising the steps of:

delivering water to a first heat exchanger of the refrigeration unit;

supplying the water from the first heat exchanger to a second heat exchanger for cooling a relatively warm fluid delivered thereto thereby increasing the temperature of the water and reducing the temperature of the relatively warm fluid; and supplying the water discharged from the second heat exchanger to the inlet of the first heat exchanger when the first heat exchanger is functioning as a refrigerant evaporator.

2. A method in accordance with claim 1 including the step of:

supplying the relatively warm fluid delivered to the second heat exchanger from the cooling system of the engine driving the refrigeration unit.

3. A method in accordance with claim 1 wherein the delivering step includes pumping the water from a body of sea water to the inlet of the first heat exchanger.

4. A method in accordance with claim 3 further including the step of returning the water discharged from the second heat exchanger to the body of sea water, while terminating the flow of water from the second heat exchanger to the inlet of the first heat exchanger when the first heat exchanger is functioning as a refrigeration condenser.

5. A method in accordance with claim 1 further including the steps of:

sensing the temperature of the water supplied to the first heat exchanger from the second heat exchanger; and operating the first heat exchanger as a refrigerant condenser until the sensed water temperature reaches a predetermined level; with said first heat exchanger thereafter functioning as a refrigerant evaporator.

6. A method in accordance with claim 5 further including the step of:

continuing to monitor the temperature of the water supplied to the first heat exchanger from the second heat exchanger; and rendering the first heat exchanger again operable as a refrigerant condenser in the event the sensed water temperature decreases below said predetermined level.

* * * * *